US012103761B1

(12) United States Patent
Dyer

(10) Patent No.: US 12,103,761 B1
(45) Date of Patent: Oct. 1, 2024

(54) CIGARETTE PACKAGING CLOSURE

(71) Applicant: Dyer Arctic Consulting, LLC, Anchorage, AK (US)

(72) Inventor: Kelly Dyer, Anchorage, AK (US)

( * ) Notice: Subject to any disclaimer, the term of this patent is extended or adjusted under 35 U.S.C. 154(b) by 0 days.

(21) Appl. No.: 18/529,031

(22) Filed: Dec. 5, 2023

(51) Int. Cl.
*A24F 13/14* (2006.01)
*B65D 41/02* (2006.01)
*B65D 85/10* (2006.01)

(52) U.S. Cl.
CPC ..... *B65D 85/10* (2013.01); *B65D 41/02* (2013.01)

(58) Field of Classification Search
CPC ..... A24F 13/14; A24F 13/16; A24F 13/00; A24F 13/02; A24F 15/12; A24F 19/0064; A24F 1/28; B65D 85/12; B65D 85/10
USPC ..... 131/187, 256, 175; 206/446, 242
See application file for complete search history.

(56) References Cited

U.S. PATENT DOCUMENTS 908,065 A * 12/1908 Berg ..... A24F 13/24 206/238
5,816,264 A * 10/1998 Sebastiani ..... B65D 81/22 131/290
2018/0116279 A1* 5/2018 Donoho ..... A24F 19/0085

* cited by examiner

*Primary Examiner* — King M Chu
(74) *Attorney, Agent, or Firm* — Alloy Patent Law; Walker Griffin Weitzel

(57) ABSTRACT

Disclosed is a child-resistant cigarette packaging closure. The cigarette packaging closure includes an inner tube, an outer tube, and a top cap. The inner tube is configured to removably retain at least one cigarette inside the inner periphery of the inner tube. The inner tube is configured to be slidably positioned inside the outer tube. The top cap is configured to be lifted off the open end of the outer tube when the outer tube slides relative to the inner tube. The cigarette packaging closure is configured to be accessed by a user that is capable of applying sufficient force, thereby ensuring that the children's accessibility of the cigarette(s) placed inside the inner periphery of the inner tube.

19 Claims, 7 Drawing Sheets

CIGARETTE PACKAGING CLOSURE

TECHNICAL FIELD

The present invention generally relates to the field of cigarette packaging. More particularly, the present invention relates to a cigarette packaging closure that is child-resistant in nature.

BACKGROUND

Cigarettes are used by millions of consumers around the world for pleasant feelings. Generally, a cigarette is cylindrical in shape and comprises a combustible material such as but not limited to: tobacco, *cannabis*, herbs, and so on rolled in a paper material to define the cylindrical shape. A user can ignite one end of the cigarette using firing means such as but not limited to matchsticks, lighters, and so on, and keep the opposite end of the cigarette in their mouth to inhale the smoke coming from igniting the one end of the cigarette.

Various types of cigarettes are available in the market and are sold by various merchandise/companies using various brand names. The cigarettes are available in various shapes, designs, sizes, and colors depending on the requirements of the user. The cigarette is often available in the packaging in the form of packs or cartons wherein the packs or cartons are rectangular boxes that comprise multiple cigarettes. Recently, "electronic cigarettes" have been introduced in the market that simulate tobacco smoking.

Cigarette smoking is quite harmful and is not recommended by medical professionals. The use of cigarettes could lead to various heart, liver, and lung-related diseases, and especially children are more vulnerable to these diseases. Generally, children are not capable of thinking about the consequences of cigarette use and are easily influenced by watching adults smoking cigarettes in real-life scenarios or in movie films. Further, generally, children are prone to easy manipulation by people in adopting cigarette smoking habits. Once the children have entered their adult life, they can better decide whether to choose the habit of cigarette smoking by comparing the risks and rewards associated with cigarette smoking. Thus, the use of cigarettes by children is not allowed in many countries and is even punishable in some countries in the form of fines. However, the packs or cartons of cigarettes can be easily opened by children. Thus, a child can easily access the cigarette by opening/tearing the cigarette pack/carton and then use the cigarette which could lead to various health problems.

Child-resistant cigarette packages are well-known in the art. The regulations for a cigarette package to be declared "child-resistant" or "child-safe" are defined by different international norms and standards. Child-resistant cigarette packages comprise different safety elements that aim to delay the time until an unauthorized person, for instance, a child, is able to open the cigarette package. This extra time should allow an authorized person such as an adult to stop the unauthorized person from opening the cigarette package.

For instance, U.S. Ser. No. 11/419,363B2 discloses a child-resistant smoking article package including a case with an opening, a child-resistant closure for closing the opening of the case, and a smoking article holder provided inside the case. The smoking article holder is coupled to the closure wherein the smoking article holder comprises at least one storage compartment configured to receive a smoking article therein.

U.S. Ser. No. 10/414,553B2 discloses a package for preserving freshness and storing elongated items. The package is preferably biodegradable, substantially airtight, child-resistant, and reusable. Various seal constructions are described for sealing a case body portion against a case lid portion. The respective sealing surfaces of the case lid portion and case body portion are complementary, but spaced. A continuous elastomeric seal is provided in the sealed space between the complementary sealing surfaces. The seal is configured to be compressed along the entire sealing length of the sealing surface when the case lid portion is pivoted into the latched position. The compressed elastomeric seal provides a spring force that retains the latch in the latched position and a spring force that is resolved into sealing vectors perpendicular to the sealing surface along the entire length of the sealing surface to ensure a seal along the sealing surface.

The existing solutions related to child-resistant cigarette packages are ineffective, have some design flaws, are difficult to manufacture, inefficient, costly, and complex in use. Thus, there remains a need for a simple, effective, efficient, cost-effective, and child-resistant cigarette package that is capable of solving the aforementioned problems of the existing solutions.

SUMMARY

Before the present systems, methods, and embodiments are described, it is to be understood that this application is not limited to the particular systems, and methodologies described, as there can be multiple possible embodiments that are not expressly illustrated in the present disclosures. It is also to be understood that the terminology used in the description is for the purpose of describing the particular versions or embodiments only, and is not intended to limit the scope of the present application. Further, it is also to be understood that the terminology if not defined by the present disclosure should be construed as the general or known meaning/definition of the terminology, known to the person skilled in the art.

It is an object of the present invention to provide a cigarette packaging closure comprising an inner tube comprising a closed end and an open end on the opposite side; wherein the inner tube is configured to removably retain at least one cigarette inside the inner periphery of the inner tube; an outer tube comprising an open end on one side and an open end on the opposite side; the inner tube is configured to slide inside the outer tube, a top cap that is configured to removably mate with the open end of the outer tube; and wherein the top cap is configured to be lifted off the open end of the outer tube, when the outer tube slides relative to the inner tube.

It is an object of the present invention to provide a cigarette packaging closure that does not allow children to access the cigarette(s) thereby protecting the health of the children.

It is an object of the present invention to provide a cigarette packaging closure that is easy to use and does not involve any complex mechanism.

It is an object of the present invention to provide a cigarette packaging closure that is cost-effective and can be used by adults of different intelligence levels.

It is another object of the present invention to provide a cigarette packaging closure that is capable of retaining at least one elongated object capable of being smoked by a user such as a conventional cigarette, electronic cigarette, beedi, cigar, kretek, and so on.

It is another object of the present invention to provide a cigarette packaging closure that is reusable and environmentally friendly.

DETAILED DESCRIPTION

Figure 1:
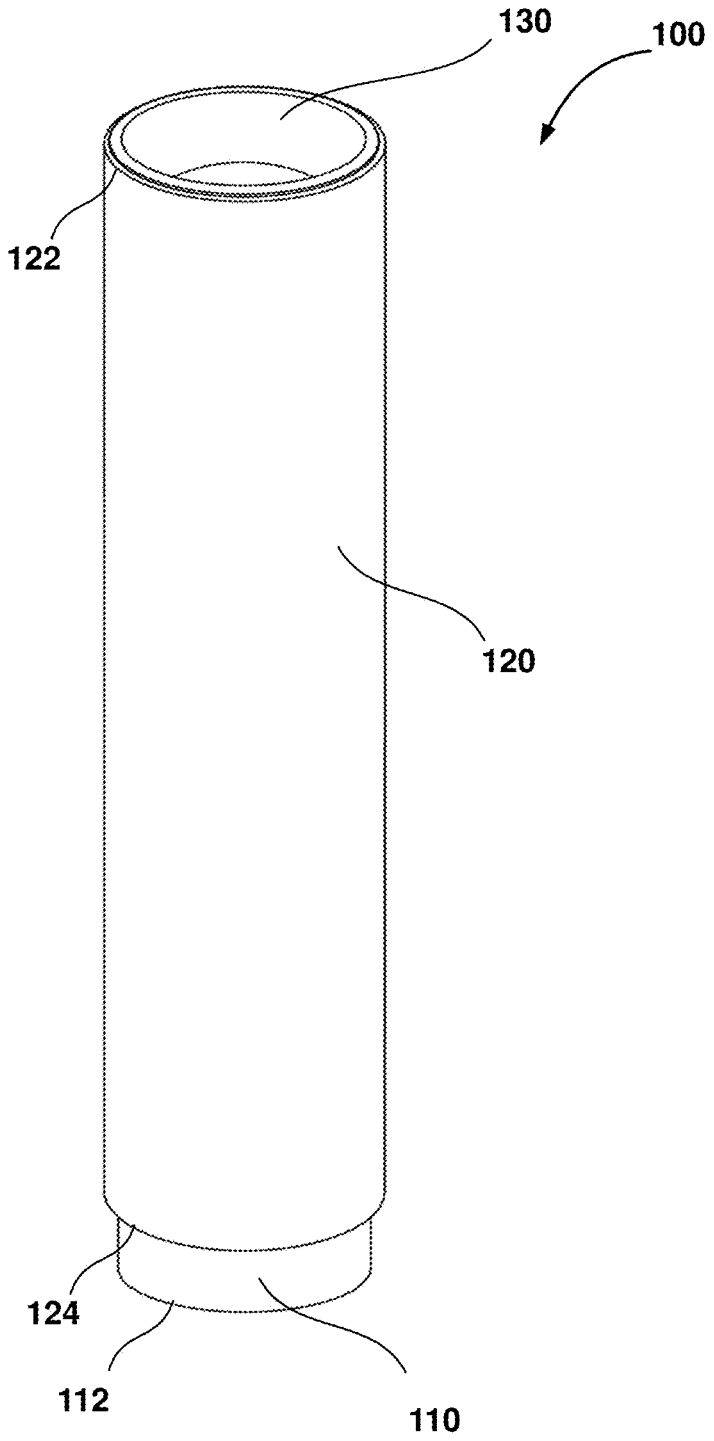
FIG. 1 illustrates a first-perspective view of a cigarette packaging closure, according to an embodiment of the present invention.

Before describing the present invention in detail, it should be observed that the present invention utilizes a combination of components or processes, which constitutes a cigarette packaging closure. Accordingly, the components or processes have been represented, showing only specific details that are pertinent for an understanding of the present invention so as not to obscure the disclosure with details that will be readily apparent to those with ordinary skill in the art having the benefit of the description herein. As required, detailed embodiments of the present invention are disclosed herein; however, it is to be understood that the disclosed embodiments are merely exemplary of the invention, which can be embodied in various forms. Therefore, specific component-level details and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

Some embodiments, illustrating its features, will now be discussed in detail. The words "comprising," "having," "containing," and "including," and other forms thereof, are intended to be equivalent in meaning and be open-ended in that an item or items following any one of these words is not meant to be an exhaustive listing of such item or items, or meant to be limited to only the listed item or items. It must also be noted that as used herein and in the appended claims, the singular forms "a," "an," and "the" include plural references unless the context clearly dictates otherwise. Although any methods, and systems similar or equivalent to those described herein can be used in the practice or testing of embodiments, the preferred methods, and systems are now described. The disclosed embodiments are merely exemplary.

References to "one embodiment", "an embodiment", "another embodiment", "one example", "an example", "another example" and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in an embodiment" does not necessarily refer to the same embodiment. The words "comprising", "having", "containing", and "including", and other forms thereof, are intended to be equivalent in meaning and be open-ended in that an item or items following any one of these words is not meant to be an exhaustive listing of such item or items or meant to be limited to only the listed item or items.

The cigarette packaging closure of the present invention will now be described with reference to the accompanying drawings, particularly FIGS. 1-7.

Figure 2:
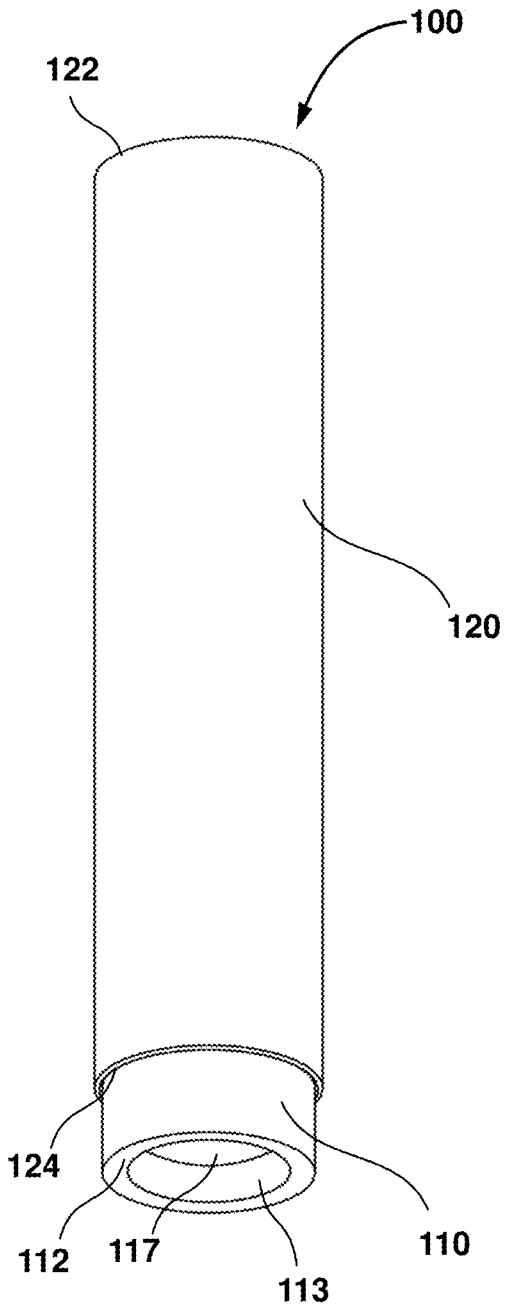
FIG. 2 illustrates a second perspective view of the cigarette packaging closure of FIG. 1.

FIG. 1 and FIG. 2 illustrate a first perspective view and a second perspective view of a cigarette packaging closure 100 respectively, according to an embodiment of the present invention. The cigarette packaging closure 100 is configured to removably hold at least one cigarette (not shown in figures) and is generally cylindrical in shape as seen in FIG. 1 and FIG. 2 to physically conform to the exterior shape of the cigarette(s) (not shown in figures). However, in another embodiment (not shown in figures), the cigarette packaging closure 100 can have any shape including but not limited to hexagon, rectangle, square, oval, triangle, octagon, and so on.

Figure 3:
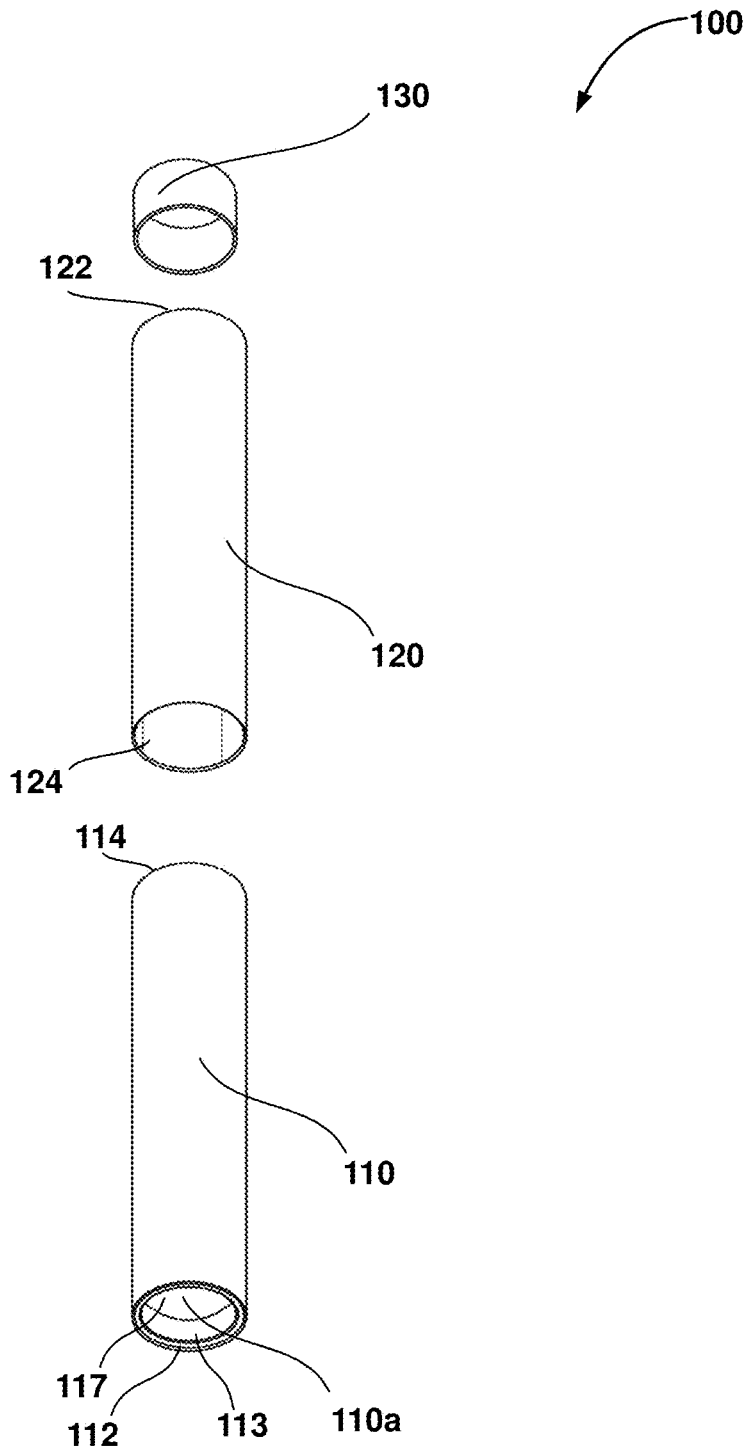
FIG. 3 illustrates an exploded view of the cigarette packaging closure of FIG. 1.

Referring to FIGS. 1-3, the cigarette packaging closure 100 comprises an inner tube 110, an outer tube 120, and a top cap 130. The inner tube 110 has a closed end 112 and an opposing open end 114. The inner tube 110 comprises a tubular space **110*a* inside to retain at least one cigarette inside the space. The outer tube 120 has an open end 122 on one side and an opposing open end 124 on the opposite side. The inner tube 110 and the outer tube 120 are dimensioned such that the inner tube 110 is configured to slide (move) inside the outer tube 120 by relatively moving against the outer tube 120. The top cap 130 is configured to removably mate with the open end 122 of the outer tube 120, thereby closing the open end 122 of the outer tube 120 when the top cap 130 is in mating arrangement with the open end 122 of the outer tube 120**.

The top cap 130 is generally cylindrical in shape as seen in FIGS. 1-3 to physically conform to the open end 122 of the outer tube 120. However, in other embodiments (not shown in figures), the cigarette packaging closure 100 could have any shape including but not limited to hexagon, rectangle, square, oval, triangle, octagon, and so on depending on the shape of the open end 122 of the outer tube 120. The removable connection between the top cap 130 and the open end 122 of the outer tube 120 is enabled by various connection means such as friction connection, sliding connection, and so on. Broadly speaking, the top cap 130 is frictionally/slidably connected (placed upon) to the open end 122 of the outer tube 120.

The outer tube 120 as well as the inner tube 110 is formed of a flexible material yet rigid enough to define the overall shape of the outer tube 120 as well as the inner tube 110. Broadly speaking, the outer tube 120 as well as the inner tube 110 are formed of a partially rigid material that can restore its original shape. The material of the outer tube 120, as well as the inner tube 110, may include but not be limited to: plastic, carbon fiber, rubber, cellulose paper, metals such as aluminum, polymers, renewable materials of plant origin such as derivates from starch, cellulose blend, and lignin basis and so on. In another embodiment, the material of the outer tube 120 as well as the inner tube 110 is biodegradable to protect the environment. The inner tube 110 is configured to removably retain at least one cigarette (not shown in figures) inside (within the space 110*a*) or the inner periphery of the inner tube 110, wherein the cigarette(s) (not shown in figures) are conventional and are sold by various merchandise/companies under various brand names. In another embodiment, the material of the outer tube 120 as well as the inner tube 110 is fully rigid such as but not limited to: metal, glass, ceramic, wood, and so on. In another embodiment, the material of the outer tube 120 as well as the inner tube 110 is transparent to allow a user to visually see the contents (cigarette) inside the cigarette packaging closure 100.

In another embodiment (not shown in figures), the inner tube 110 and the outer tube 120 are magnetically connected to each other such that the inner tube 110 is configured to slide (move) inside the outer tube 120 by relatively moving against the outer tube 120. At least one of the inner tubes 110 and/or the outer tube 120 comprises magnets (not shown in figures) and the remaining element that is an inner tube 110 or the outer tube 120 could comprise ferromagnetic material such as iron or magnet (not shown in figures).

The overall length of the outer tube 120 as well as the inner tube 110 is optimally designed to ensure the functionality of the cigarette packaging closure 100. Further, the radius of the outer tube 120 as well as the inner tube 110 is kept close enough (small tolerance) to ensure that the outer tube 120 can easily slide relative to the inner tube 110, and at the same time, the outer tube 120 is temporarily held against the inner tube 110 by the frictional force between the outer tube 120 and the inner tube 110.

It should be understood that the term cigarette(s) (not shown in figures) could include any elongated object that is capable of being smoked by a user. Broadly speaking, the cigarette packaging closure 100 is capable of retaining at least one elongated object capable of being smoked by a user such as a conventional cigarette, electronic cigarette, beedi, cigar, kretek, and so on.

Referring to FIG. 2 and FIG. 3, the closed end 112 of the inner tube 110 is hollow shaped in nature and the inner tube 110 includes a cylindrical wall 113 that is configured to contact against the ground surface (not shown in figures) on which the cigarette packaging closure 100 is placed, and a circular wall surface 117.

In another embodiment (not shown in figures), the outer tube 120 may have any design feature (not shown in figures) provided on the exterior surface of the outer tube 120 for aesthetic appeal and/or decorative effect. The design feature (not shown in figures) could include but is not limited to stickers, color patterns, three-dimensional design, glossy design, photographs, paintings, artistic work, metal finish, tattoo, wood pattern, textile/fabric design, and sewing/stitching designs/patterns and so on. The design feature (not shown in the figures) could be integrated (incorporated) into the outer tube 120. Alternatively, the user can customize the outer tube 120 by selecting the design feature (not shown in figures) and then installing (later adding) the design feature (not shown in figures) on the exterior surface of the outer tube 120.

Figure 4:
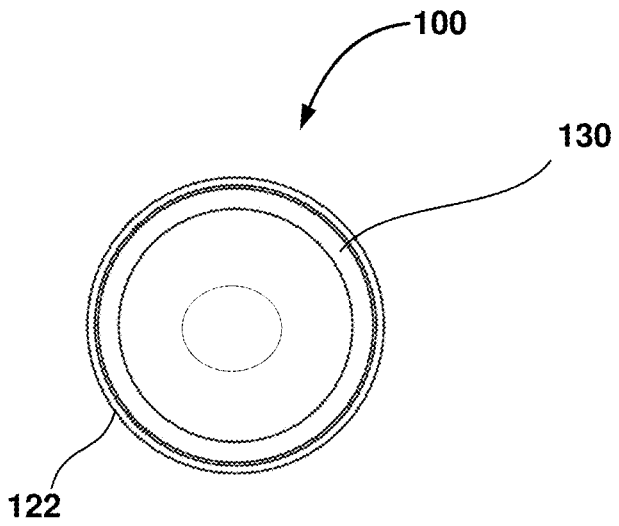
FIG. 4 illustrates a top view of the cigarette packaging closure of FIG. 1.
Figure 5:
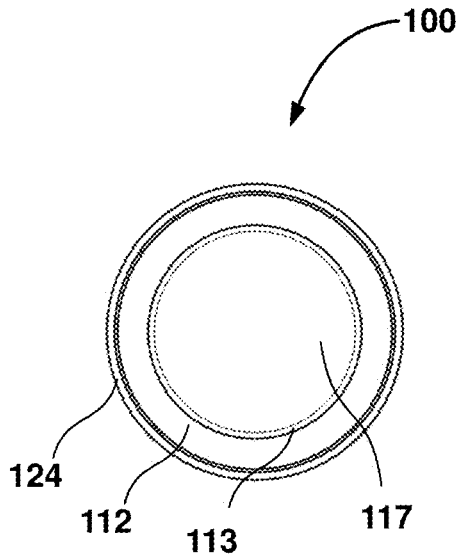
FIG. 5 illustrates a bottom view of a cigarette packaging closure of FIG. 1.

FIG. 4 and FIG. 5 illustrate a top view and a bottom view of a cigarette packaging closure 100. The top cap 130 is configured to be lifted off (popped out) the open end 122 of the outer tube 120 when the outer tube 120 slides relative to the inner tube 110. Broadly speaking, the top cap 130 is configured to be lifted off (popped out) the open end 122 of the outer tube 120 when a user grips the upper portion of the outer tube 120 and then applies sufficient downward force directed towards the opposite open end 124 of the outer tube 120. The top cap 130 could be made of any material having sufficient strength such as but not limited to: plastic, metal, composites, wood, polymers, cellulose, and so on.

In another embodiment (not shown in figures), the top cap 130 is configured to be lifted off (popped out) the open end 122 of the outer tube 120 when a user grips the upper portion of the outer tube 120 and then applies sufficient inward radial (squeezing) force directed towards the upper portion of the outer tube 120.

In another embodiment (not shown in figures), the top cap 130 is configured to be lifted off (popped out) the open end 122 of the outer tube 120 when a user grips the upper portion of the outer tube 120 and then simultaneously applies sufficient force in two directions (manner) wherein the sufficient force is equal to sum of inward radial (squeezing) force directed towards the upper portion of the outer tube 120 and the downward force directed towards the opposite open end 124 of the outer tube 120.

In another embodiment (not shown in figures), the top cap 130 and the open end 122 of the outer tube 120 are made of highly magnetic material such that the top cap 130 is magnetically attracted (connected) to the open end 122 of the outer tube 120. When a user (adult) pulls the top cap 130 from the upper portion of the outer tube 120 by applying sufficient upward force directed away from the opposite open end 124 of the outer tube 120, the high magnetic force between the top cap 130 and the open end 122 of the outer tube 120 is overcome by the sufficient upward force of the user, and the top cap 130 is pulled apart from the upper portion of the outer tube 120.

Figure 6:
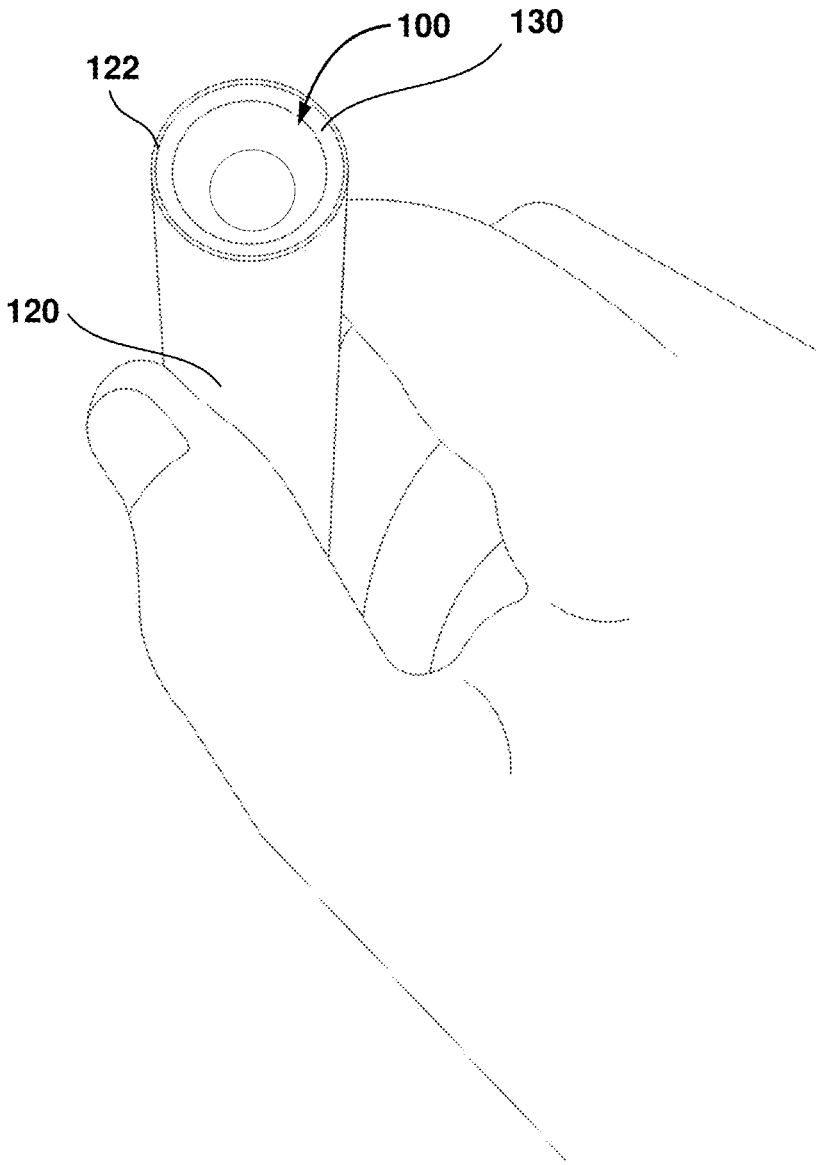
FIG. 6 illustrates a user opening the cigarette packaging closure of FIG. 1 to access the cigarette(s) by using his hands.

FIG. 6 illustrates a user opening the cigarette packaging closure 100 by using his hands. A user can grip the upper portion of the outer tube 120 and then apply sufficient downward force directed towards the open end 124 of the outer tube 120. As a result, the outer tube 120 slides relative to the inner tube 110, thereby enabling the contact between the open end 114 of the inner tube 110 against the top cap 130 initially seated (placed) on the open end 122 of the outer tube 120, thereby lifting off (popping out) the top cap 130 from the open end 122 of the outer tube 120. Afterward, the user can remove the cigarette (not shown in figures) placed inside the inner periphery of the inner tube 110 (within space 110*a*) and then use the cigarette(s) (not shown in figures) to fulfill their needs. It should be noted that only the user who is an adult is capable of applying sufficient downward force directed towards the open end 124 of the outer tube 120 can access the cigarette (not shown in figures) placed inside the inner periphery of the inner tube 110. The children are generally not capable of providing such sufficient downward force and thus cannot access the cigarette (not shown in figures) placed inside the inner periphery of the inner tube 110, thereby making the cigarette packaging closure 100 child-resistant in nature.

Figure 7:
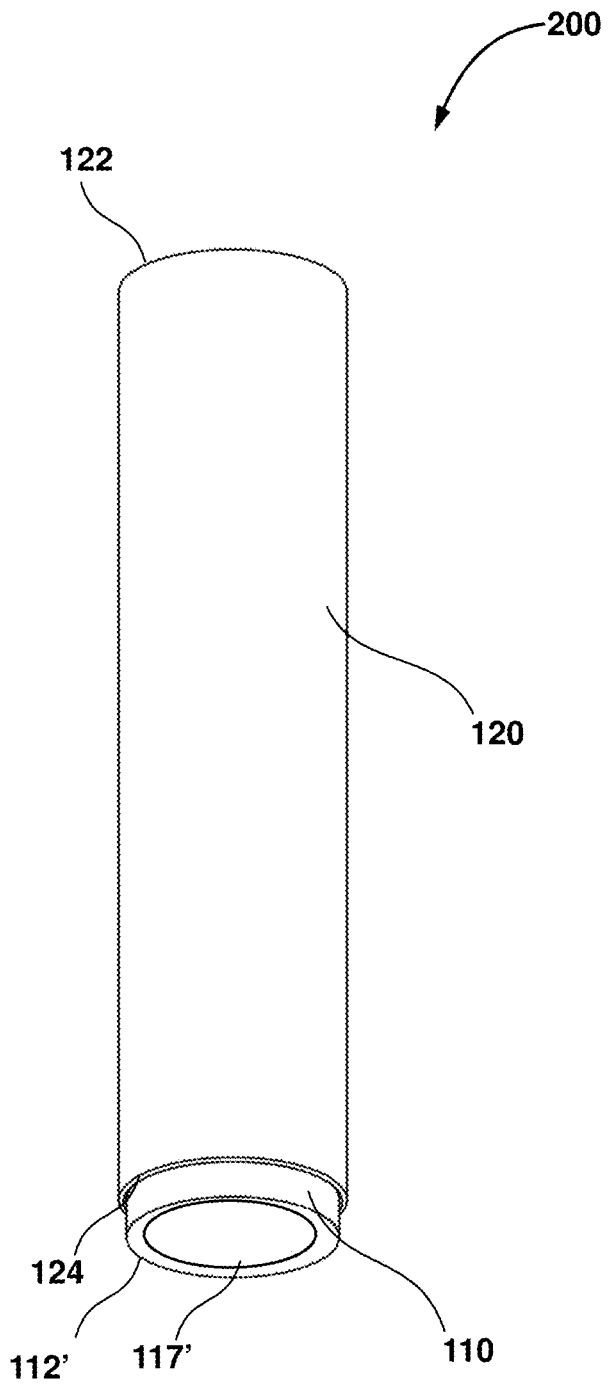
FIG. 7 illustrates a perspective view of a cigarette packaging closure, according to another embodiment of the present invention.

FIG. 7 illustrates a perspective view of a cigarette packaging closure 200, according to another embodiment of the present invention. The cigarette packaging closure 200 is similar to the cigarette packaging closure 100 of FIGS. 1-6 except the geometric modifications associated with the closed end 112 of the inner tube 110. A closed-end 112' of the inner tube 110 of the cigarette packaging closure 200 is flat shaped in nature and the inner tube 110 includes a circular wall surface 117' that is configured to contact against the ground surface (not shown in figures) on which the cigarette packaging closure 200 is placed. The circular wall surface 117' is essentially parallel (flush) to the ground surface (not shown in figures) on which the cigarette packaging closure 200 is placed.

Certain advantages of the cigarette packaging closure (100, 200) of the present disclosure are listed herein below:

Cigarette packaging closure (100, 200) does not allow children to access the cigarette(s) (not shown in figures) thereby protecting the health of the children. The top cap 130 removal requires about 5 kg m/s$^2$ of force to open the cigarette packaging closure (100, 200) according to an embodiment of the invention which is often difficult for children. This makes access to the cigarette(s) difficult thereby protecting the health of the children.

Cigarette packaging closure (100, 200) is easy to use and does not involve any complex mechanisms. Thus, the cigarette packaging closure (100, 200) is cost-effective and could be used by adults of different intelligence levels.

Cigarette packaging closure (100, 200) is capable of retaining at least one elongated object capable of being smoked by a user such as a conventional cigarette, electronic cigarette, beedi, cigar, kretek, and so on.

Cigarette packaging closure (100, 200) is capable of being reused by the user and is environment-friendly. A user who is an adult can place at least one cigarette (not shown in figures) in the inner tube 110 and close the open end 122 of the outer tube 120 with the top cap 130. Then, the adult user can access the cigarette(s) (not shown in figures) placed in the inner tube 110 by applying a sufficient downward force to lift off the top cap 130 from the open end 122 of the outer tube 120. Afterward, the user can use the cigarette(s) (not shown in figures) by removing the cigarette(s) (not shown in figures) from the inner tube 110 and igniting it by using a firing means (not shown in figures). Afterward, the user can insert a new (fresh) cigarette (not shown in figures) in the inner tube 110 and close the open end 122 of the outer tube 120 with the top cap 130. The above-mentioned process can be repeated again by the user to use the new (fresh) cigarette (not shown in the figures). Thus, a single Cigarette packaging closure could be used multiple times by users, which creates less environmental waste when compared with the existing single-use cigarette packs and cartons.

It should be understood that the cigarette packaging closure (100, 200) is capable of retaining multiple cigarettes (not shown in figures) as well as a single cigarette (not shown in figures). The multiple cigarettes (not shown in figures) could be arranged in various patterns inside the inner tube 110 such as linear pattern, array pattern, circular pattern, triangle pattern, bundle pattern, and so on. Thus, the shape and size of the cigarette packaging closure (100, 200) could vary depending on the requirements of the user.

The various components and parts of the various embodiments of the cigarette packaging closure (100, 200) of the present invention are similar and interchangeable. It is obvious to the one skilled in the art that the various components, and parts of the cigarette packaging closure (100, 200) of one embodiment of the present invention could be considered for other embodiments with little or no variation.

It should be understood according to the preceding description of the present invention that the same is susceptible to changes, modifications and adaptations, and that the said changes, modifications and adaptations fall within scope of the appended claims.

What is claimed is:

1. A cigarette packaging closure (100), comprising:

an outer tube (120) comprising a first open end (122), and an opposingly configured second open end (124);

an inner tube (110) comprising a closed end (112) and an opposing open end (114), the inner tube (110) comprises a tubular space (110*a*) configured to removably retain at least one cigarette there inside;

wherein the outer tube 120 is held against the inner tube 110 by the frictional force between the outer tube 120 and the inner tube 110 and wherein the inner tube (110) is able to slidably move within the outer tube (120);

a top cap (130) configured to removably mate with the first open end (122) of the outer tube (120), thereby closing the first open end (122) of the outer tube (120); and wherein the top cap (130) is configured to be lifted off the first open end (122) of the outer tube (120) when the outer tube (120) is slidably moved relative to the inner tube (110).

2. The cigarette packaging closure (100) of claim 1, wherein the inner tube (110) and outer tube (120) are cylindrically shaped and have dimensions to allow the inner tube (100) to slidably move within the outer tube (120).

3. The cigarette packaging closure (100) of claim 1, wherein the top cap (130) is cylindrical in shape that physically conforms to the shape of the first open end (122) of the outer tube (120).

4. The cigarette packaging closure (100) of claim 3, wherein the top cap (130) is slidably connected to the first open end (122) of the outer tube (120).

5. The cigarette packaging closure (100) of claim 1, wherein the outer tube (120) and the inner tube (110) are formed of a flexible material partially rigid in nature or fully rigid to define the overall shape of the outer tube (120) and the inner tube (110).

6. The cigarette packaging closure (100) of claim 5, wherein the material of the outer tube (120) and the inner tube (110) is selected from the group of material consisting of plastic, carbon fiber, rubber, cellulose paper, metals, wood, ceramic, glass, renewable materials of plant origin, biodegradable material.

7. The cigarette packaging closure (100) of claim 5, wherein the outer tube (120) and the inner tube (110) are made transparent to allow a user to visually see the at least one cigarette stored inside the cigarette packaging closure (100).

8. The cigarette packaging closure (100) of claim 1, wherein the inner tube (110) and the outer tube (120) are magnetically connected to each other such as to enable the inner tube (110) to slidably move inside the outer tube (120).

9. The cigarette packaging closure (100) of claim 1, wherein the inner tube (110) is hollow inside and includes a circular wall surface (117) and a cylindrical wall (113) contacting against a surface on which the cigarette packaging closure (100) is placed.

10. The cigarette packaging closure (100) of claim 1, wherein the outer tube (120) comprises one or more design features provided on the exterior surface for aesthetic appeal and/or decorative effect.

11. The cigarette packaging closure (100) of claim 10, wherein the one or more design features comprises at least stickers, color patterns, three-dimensional designs, glossy design, photographs, paintings, artistic work, metal finish, tattoo, wooden pattern, textile/fabric design, and sewing patterns.

12. The cigarette packaging closure (100) of claim 1, wherein the top cap (130) is lifted off the first open end (122) of the outer tube (120) by at least gripping an upper portion of the outer tube (120) and applying sufficient downward force directed towards the second open end (124) of the outer tube (120);

gripping the upper portion of the outer tube (120) and then applying sufficient inward radial force directed toward the upper portion of the outer tube (120); and gripping the upper portion of the outer tube (120) and then simultaneously applying sufficient force in two directions wherein the force being equal to the sum of inward radial force directed towards the upper portion of the outer tube (120) and the downward force directed towards the opposite open end (124) of the outer tube (120).

13. The cigarette packaging closure (100) of claim 12, wherein the top cap (130) is lifted off the first open end (122) of the outer tube (120) using about 5 kg $m/s^2$ of force.

14. The cigarette packaging closure (100) of claim 1, wherein the top cap (130) is magnetically attracted to the first open end (122), of the outer tube (120).

15. A cigarette packaging closure (100), comprising:

an outer tube (120) comprising a first open end (122), and an opposingly configured second open end (124);

an inner tube (110) comprising a closed end (112) and an opposing open end (114), the inner tube (110) comprises a tubular space (110*a*) configured to removably retain at least one cigarette there inside;

wherein the inner tube (110) and the outer tube (120) are magnetically connected to each other such as to enable the inner tube (110) to slidably move inside the outer tube (120);

a top cap (130) configured to removably mate with the first open end (122) of the outer tube (120), thereby closing the first open end (122) of the outer tube (120); and wherein the top cap (130) is configured to be lifted off the first open end (122) of the outer tube (120) to allow access to the at least one cigarette retained inside the tubular space (110*a*) of the inner tube (110).

16. The cigarette packaging closure (100) of claim 15, wherein the top cap (130) is slidably connected to the first open end (122) of the outer tube (120).

17. A cigarette packaging closure (100), comprising:

an outer tube (120) comprising a first open end (122), and an opposingly configured second open end (124);

an inner tube (110) comprising a closed end (112) and an opposing open end (114), the inner tube (110) comprises a tubular space (110*a*) configured to removably retain at least one cigarette there inside, wherein the inner tube (110) is able to slidably move within the outer tube (120);

a top cap (130) is slidably connected to the first open end (122) of the outer tube (120), thereby closing the first open end (122) of the outer tube (120); and wherein the top cap (130) is configured to be lifted off the first open end (122) of the outer tube (120) when the outer tube (120) is slidably moved relative to the inner tube (110).

18. The cigarette packaging closure (100) of claim 17, wherein the top cap (130) is cylindrical in shape that physically conforms to the shape of the first open end (122) of the outer tube (120).

19. The cigarette packaging closure (100) of claim 17, wherein the top cap (130) is lifted off the first open end (122) of the outer tube (120) by at least gripping an upper portion of the outer tube (120) and applying sufficient downward force directed towards the second open end (124) of the outer tube (120);

gripping the upper portion of the outer tube (120) and then applying sufficient inward radial force directed toward the upper portion of the outer tube (120); and gripping the upper portion of the outer tube (120) and then simultaneously applying sufficient force in two directions wherein the force being equal to the sum of inward radial force directed towards the upper portion of the outer tube (120) and the downward force directed towards the opposite open end (124) of the outer tube (120).

* * * * *